US012767423B2

(12) United States Patent
Cho et al.

(10) Patent No.: US 12,767,423 B2
(45) **Date of Patent: *Oct. 20, 2026**

(54) ACTUATOR FOR DISPENSING A FLUENT PRODUCT

(71) Applicant: AptarGroup, Inc., Crystal Lake, IL (US)

(72) Inventors: Sean Cho, Elgin, IL (US); Gregory Erickson, Wheaton, IL (US)

(73) Assignee: AptarGroup, Inc., Crystal Lake, IL (US)

( * ) Notice: Subject to any disclaimer, the term of this patent is extended or adjusted under 35 U.S.C. 154(b) by 358 days.

This patent is subject to a terminal disclaimer.

(21) Appl. No.: 18/363,926

(22) Filed: Aug. 2, 2023

(65) Prior Publication Data

US 2024/0010419 A1 Jan. 11, 2024

Related U.S. Application Data

(63) Continuation of application No. 17/761,297, filed as application No. PCT/US2020/055732 on Oct. 15, 2020, now Pat. No. 11,794,984.

(60) Provisional application No. 62/915,299, filed on Oct. 15, 2019.

(51) Int. Cl.

| | |
|---|---|
| ***B65D 83/20*** | (2025.01) |
| ***B65D 83/206*** | (2025.01) |
| ***B65D 83/34*** | (2006.01) |

(52) U.S. Cl.

CPC ..... *B65D 83/206* (2013.01); *B65D 83/345* (2013.01)

(58) Field of Classification Search

CPC ..... B65D 83/14; B65D 83/16; B65D 83/20; B65D 83/28; B65D 83/30; B65D 83/205; B65D 83/206; B65D 83/22; B65D 83/345

USPC ..... 222/402.1–402.13

See application file for complete search history.

(56) References Cited

U.S. PATENT DOCUMENTS

| | | | | |
|---|---|---|---|---|
| 3,314,426 A | | 4/1967 | Carroll | |
| 3,373,908 A | * | 3/1968 | Crowell | B65D 83/205 222/402.13 |
| 3,738,537 A | | 6/1973 | Gach | |
| 3,904,088 A | | 9/1975 | Milbourne, Sr. | |
| 3,985,868 A | * | 10/1976 | Corey, Jr. | C07D 295/215 222/395 |
| 4,187,963 A | * | 2/1980 | Mascia | B65D 83/205 222/402.13 |

(Continued)

FOREIGN PATENT DOCUMENTS

| | | | |
|---|---|---|---|
| JP | 6504883 | B2 | 4/2019 |
| WO | 2012002333 | A1 | 1/2012 |
| WO | 2013055323 | A | 4/2013 |

*Primary Examiner* — Charles P. Cheyney

(74) *Attorney, Agent, or Firm* — Wood, Phillips, Katz, Clark & Mortimer

(57) ABSTRACT

An improved actuator for actuating a container of a pressurized fluent product includes a body having a dispensing flow path to direct a pressurized fluent product from the container to an exterior of the actuator via an exit orifice located at an end of the flow path. The body further includes a front exterior face located adjacent to the exit orifice and a hollow extension defining a portion of the flow path and extending along, and centered on, a longitudinal axis. The hollow extension configured to retain an accumulation of the fluent product at the exit orifice at a location that is spaced away from the front exterior face.

4 Claims, 9 Drawing Sheets

(56) References Cited

U.S. PATENT DOCUMENTS

| | | | | |
|---|---|---|---|---|
| 4,428,509 | A * | 1/1984 | Emerson | B65D 83/44 222/153.02 |
| 5,234,140 | A | 8/1993 | Demarest | |
| 5,649,645 | A | 7/1997 | Demarest et al. | |
| 5,785,250 | A | 7/1998 | De Laforcade | |
| 6,006,957 | A | 12/1999 | Kunesh | |
| 6,817,493 | B1 | 11/2004 | Parsons et al. | |
| 6,820,823 | B2 | 11/2004 | Parsons et al. | |
| 7,104,427 | B2 | 9/2006 | Pericard et al. | |
| 7,600,701 | B2 | 10/2009 | Jasper et al. | |
| 8,820,665 | B2 * | 9/2014 | Nelson | B05B 1/042 239/593 |
| 9,393,336 | B2 * | 7/2016 | Shah | A61L 9/14 |
| 9,999,895 | B2 | 6/2018 | Nelson | |
| 11,033,913 | B2 * | 6/2021 | Songbe | B05B 1/3463 |
| 2004/0245294 | A1 * | 12/2004 | Mineau | B65D 83/205 222/402.13 |
| 2009/0078793 | A1 * | 3/2009 | Nelson | C09K 3/30 239/592 |
| 2016/0236853 | A1 * | 8/2016 | Verville | B65D 83/205 |

* cited by examiner

ACTUATOR FOR DISPENSING A FLUENT PRODUCT

PRIORITY

This application is a continuation of U.S. patent application Ser. No. 17/761,297, filed Mar. 17, 2022, which is a national phase of International Patent Application No. PCT/US2020/055732, filed Oct. 15, 2020, which claims priority to U.S. Provisional Application Ser. No. 62/915,299, filed Oct. 15, 2019, the entire contents of which are incorporated herein by reference.

TECHNICAL FIELD

The present invention relates generally to hand-held dispensing packages for dispensing fluent material, typically in the form of a spray or foam, from a container, which can be pressurized or non-pressurized. A finger-operable actuator is used in such dispensing packages to actuate a valve to dispense the fluent product from the container. The invention more particularly relates to dispensing packages having an actuator that provides a cleaner mode of dispensing, which exhibits a substantial reduction or minimization of fluent product accumulation on the actuator subsequent to dispensing.

BACKGROUND OF THE INVENTION AND TECHNICAL PROBLEMS POSED BY THE PRIOR ART

Finger-operable actuators are typically adapted to be incorporated in dispensing systems mounted on hand-held containers that are commonly used for fluent products. Some actuators are designed for use with a valve assembly and have a suitable discharge structure to produce a foam, mousse, or atomized spray. A dispensing system comprising such a valve assembly and cooperating actuator is typically used for dispensing household products, such as cleaning products, deodorizers, insecticide; and other fluent products, such as cosmetic products or other personal care products such as shaving cream or shaving foam, hair mousse, sun care products, etc., as well as other institutional and industrial products.

Dispensing systems comprising a valve assembly and cooperating actuator are typically mounted at the top or opening of a container, such as a metal can containing a pressurized product. The container, the product and any propellant in the container, the valve assembly, and the actuator all together make up a dispensing package. The actuator typically includes a component that is connected to the valve assembly external of the container and that provides a dispensing flow path or passage from the valve assembly and through which the product can be dispensed to a target area.

For some types of fluent products, the dispensing system may be provided with a structure in the actuator to direct or shape the spray pattern of the fluent product as it is dispensed from the actuator. In current systems, this structure is provided in the form of a nozzle insert having special configurations in the orifice or orifices of the insert that provide the spray pattern. U.S. Patent Publication No. 2007/0090208 A1 shows some examples of such nozzle inserts and PCT Publication No. WO 2013/055323 A1 illustrates generally such actuators, each reference being incorporated by reference in its entirety as if fully set forth herein.

While current actuators may work well for their intended purpose of facilitating the movement of a fluent product, such as a foaming liquid, from the container to the exterior of the actuator, such current actuators have been found by the inventors to accumulate significant amounts of residual, dispensed fluent product at or near the exit orifice, nozzle, and/or container.

There exists a need for a feasible, cost-effective, solution for improved dispensing, particularly with respect to pressurized foaming spray products, wherein the foaming spray (comprising, for example, particles and/or droplets) expands at atmospheric pressure into a foam product.

The inventors of the present invention have discovered that, in at least some applications, it would be desirable to provide an improved actuator, particularly suitable for use with foaming products, which exhibits improved cleanliness and the elimination, or at least reduction, of the accumulation of foam residue at the exit orifice of the actuator after the use, or repeated uses, of a package containing the actuator.

The inventors of the present invention have determined that, in at least some applications, it would be desirable to provide an improved actuator, particularly suitable for use with foaming products, which exhibits improved cleanliness and the elimination, or at least reduction, of bridging of foam residue between the exit orifice of the actuator and the valve cup after repeated uses of a package containing the actuator.

The inventors of the present invention have further determined that, for at least some applications, it may be desirable to provide such an improved actuator that can be easily assembled, disassembled, and/or cleaned.

The inventors of the present invention have also determined that it would be desirable to provide, at least for some applications, an improved actuator that can exhibit improved cleanliness across a wide variety of foaming fluent substances having different formulations.

The inventors of the present invention have also discovered that it would be desirable to provide, at least for some applications, an improved actuator that can be manufactured and/or assembled at a relatively low cost, and can accommodate manufacture of the actuator by means of efficient, high-quality, large-volume techniques, and that can facilitate the minimization of plastic and part weight.

The inventors of the present invention have discovered how to provide such an actuator that includes novel, advantageous features not heretofore taught or contemplated by the prior art, and which can accommodate designs having one or more of the above-discussed benefits or features.

SUMMARY OF THE INVENTION

In accordance with one broad form of the invention, an actuator is provided for actuating a valve on a container of a fluent product. The actuator has a body including a downwardly extending skirt defining a lower end for surrounding at least a portion of the container. The body includes a dispensing flow path to direct a fluent product from the container to an exterior of the actuator via an exit orifice located at an end of the flow path. The body further includes a front exterior face located adjacent to the exit orifice and a hollow extension extending from the front exterior face and defining at least a portion of the flow path and extending along, and centered on, a longitudinal axis. A terminal portion of the hollow extension extends outwardly from a portion of the front exterior face along the longitudinal axis, and the terminal portion of the hollow extension is located axially inwardly of the lower end, relative to the longitudinal axis. The hollow extension is configured to retain an accumulation of the fluent product at the exit orifice at a location that is spaced radially away from the front exterior face relative to the longitudinal axis.

In one feature of the invention, the pressurized fluent product is a foaming liquid or a spray foam. Preferably, the actuator retains the dispensed foam in a spheroid or bolus at the exit orifice without any substantial accumulation of dispensed foam product on the front exterior face of the actuator after repeated uses of the actuator.

According to one feature, the hollow extension further includes a post extending within the hollow extension generally along the longitudinal axis, the post defining an end face. Preferably, the end face is located axially inward of the exit orifice along the longitudinal axis.

In one form of the invention, the actuator further includes an insert for being retained within the hollow extension. The insert has a plate defining at least one exit orifice for overlying the end face of the post with the insert in an assembled configuration retained within the hollow extension. According to one preferred form of the invention, the plate of the insert is spaced between about 0.5 and about 1.0 millimeters from the exit orifice with the insert in its assembled configuration retained within the hollow extension. In some forms, the end face may be flush or even with the exit orifice or may slightly protrude outwardly from the longitudinal axis.

According to one preferred form of the invention, the terminal portion of the hollow extension is radially spaced above a portion of the front exterior face, relative to the longitudinal axis, preferably by at least 6 millimeters.

According to yet another preferred form of the invention, the hollow extension extends axially outwardly from its connection with the front exterior face by at least about 3 millimeters along the longitudinal axis.

In yet another feature of the present invention, the flow path of the actuator body defines an internal volume of less than about 30 cubic millimeters.

In yet another from of the present invention, the front exterior face includes a plurality of concentric or at least arcuate ridges surrounding the hollow extension.

According to one feature, the front exterior face is generally concave and fully surrounds the hollow extension. Preferably, the front exterior face is dish-like while a remainder of the actuator body is round or spherical.

In a preferred form of the present invention, the hollow extension has a wall thickness of about 1.25 millimeters at the exit orifice and/or has an external diameter of between about 5 and about 9 millimeters.

In another form of the invention, the hollow extension includes a chamfered surface surrounding the exit orifice.

In another form of the invention, the body further includes a deflectable actuator button that is cantilevered rearwardly relative to the front exterior face. In other forms of the present invention, the deflectable actuator button is cantilevered forwardly of (over), or vertically above, the front exterior face.

In still another form of the invention, the actuator body is unitarily formed from a thermoplastic material.

According to another feature of the invention, the actuator is assembled in combination with an insert, a valve, and a container of a fluent foaming liquid product—all together defining a package.

In accordance with another broad form of the invention, an actuator is provided for actuating a valve on a container of a fluent product. The actuator has a body including a downwardly extending skirt defining a lower end for surrounding at least a portion of the container. The body includes a dispensing flow path to direct a fluent product from the container to an exterior of the actuator via an exit orifice located at an end of the flow path. The body further includes a front exterior face located adjacent to the exit orifice and a hollow extension defining at least a portion of the flow path and extending along, and centered on, a longitudinal axis. A terminal portion of the hollow extension extends outwardly from a portion the front exterior face along the longitudinal axis, and the terminal portion of the hollow extension is located axially inwardly of the lower end, relative to the longitudinal axis. The body further includes a deflectable actuator button that is cantilevered rearwardly relative to the front exterior face which is generally concave when viewed from the exterior of the actuator and which fully surrounds the hollow extension. The hollow extension further includes a post extending within the extension generally along the longitudinal axis. The post defines an end face located axially inwardly of the exit orifice along the longitudinal axis. The actuator is further provided with an insert for being retained within the hollow extension and which has at least one aperture for overlying the end face of the post with the insert in its assembled configuration retained within the hollow extension. The hollow extension is configured to retain an accumulation of the fluent product at the exit orifice at a location that is spaced radially away from (above) a portion of the front exterior face relative to the longitudinal axis.

Other objects, features, and advantages of the invention will become apparent from a review of the entire specification, including the appended claims and drawings.

BRIEF DESCRIPTION OF THE DRAWINGS

FIG. 2 shows an insert prior to its installation at the exit orifice of the actuator;

FIG. 7 is a photograph comparing two prior art actuators (the first two actuators at the left of the photograph) installed on containers of a fluent substance and three actuators according to the present invention (the last three actuators at the right of the photograph) installed on containers of a fluent substance, wherein FIG. 7 shows the substantial reduction in accumulation of a foam product on the inventive actuators after actuation compared to the prior art actuators after actuation, and FIG. 7 further shows that the accumulated foam product on inventive actuators is advantageously retained at the exit orifice or nozzle at a location spaced from the front exterior surface of the actuator and the container itself;

FIGS. 8A-8C are photographs showing an actuator according to the present invention over time, wherein FIG. 8A shows an initial (i.e., first) actuation or use of the actuator to dispense a fluent substance, FIG. 8B shows a resting state of the actuator just after the initial (i.e., first) actuation shown in FIG. 8A, and FIG. 8C shows the actuator during a second actuation wherein an accumulation or residue of fluent material remaining on the actuator at the exit orifice after an initial actuation is advantageously ejected during the second actuation; FIG. 9 shows the actuator prior to installation of an insert.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention are described in a typical (upright) position, and terms such as upper, lower, radial, axial, above, below, etc., are used with reference to this position that the actuator would have when installed upon an upright container of a fluent product (the container being only partially illustrated in FIG. 2). It will be understood, however, that the components embodying this invention may be manufactured, stored, transported, used, and sold in an orientation other than the position described.

Figures illustrating the components of this invention omit the valve and the container (with the exception of FIG. 2), which are conventional mechanical elements that are known and that will be recognized by one skilled in the art. The detailed descriptions of such cooperating elements are not necessary to an understanding of the invention, and accordingly, are herein presented only to the degree necessary to facilitate an understanding of the novel features of the present invention.

As will be further described in detail, the present invention is directed to an actuator for dispensing fluent material or product (and is especially suitable for dispensing a pressurized foam). The inventive actuator can dispense types of fluent materials or substances in a manner that minimizes or at least reduces the accumulation of dispensed fluent material on one or more of the actuator, container, or user.

FIGS. 1-6 illustrate a first embodiment of an actuator 20 according to the present invention, and such an actuator is suitable for use in a hand-held dispensing package including a pressurized container (e.g., 24 in FIG. 2) containing a fluent product (visible in FIG. 8A), and a dispensing valve in the form of an aerosol dispensing valve (e.g., 28 in FIG. 2) or other conventional valve.

It should be understood that the container 24 and the valve 28 can be of any conventional, known construction, and accordingly will only be briefly described herein. The container 24 is typically a metal can having an upper edge rolled into a mounting bead surrounding a container opening (not visible in FIG. 2). The container 24 could be a PET container. The container 24 is adapted to hold the fluent product (e.g., a liquid) and pressurized gas below the dispensing valve 28.

Figure 2:
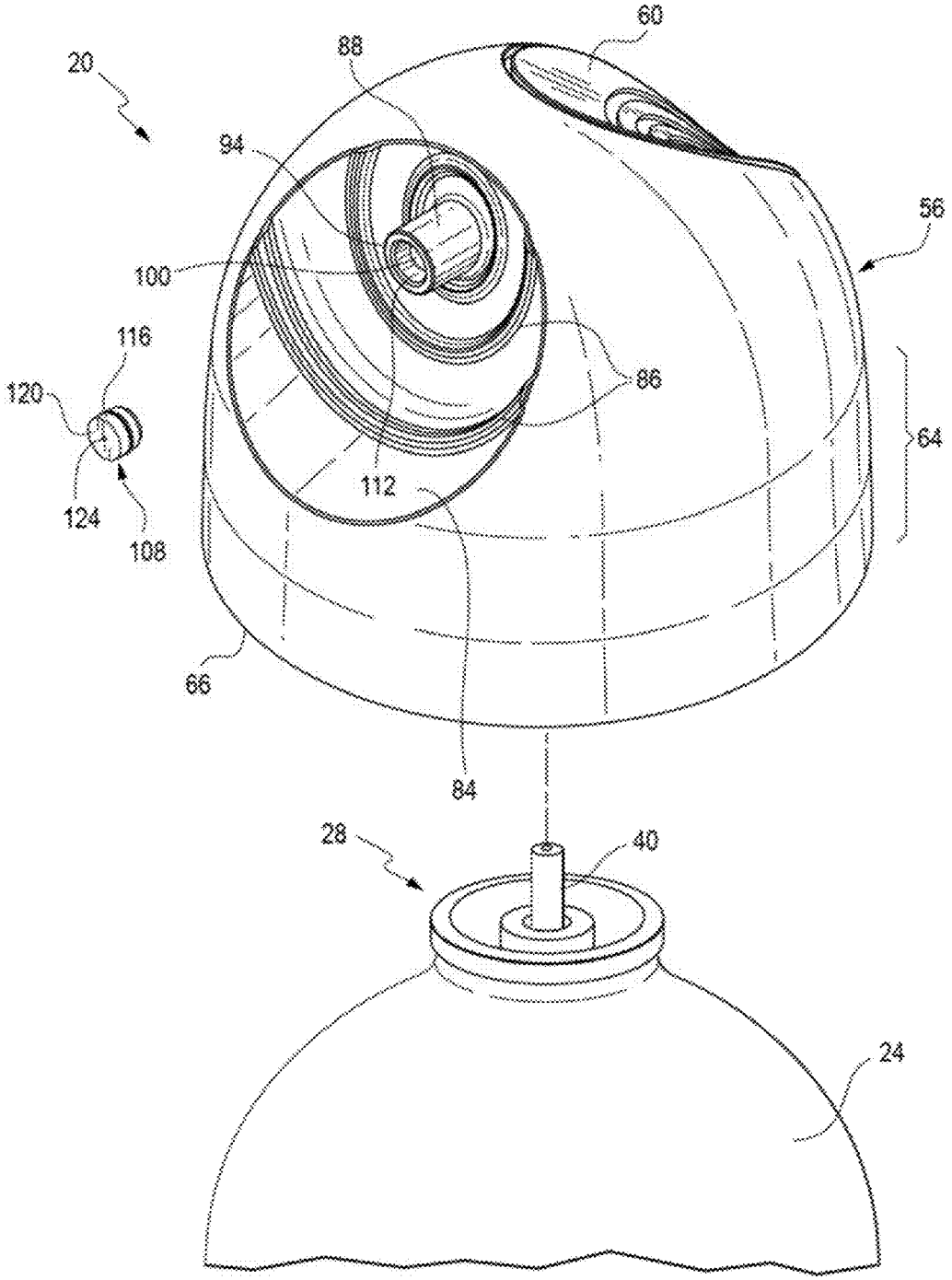
FIG. 2 is an isometric, exploded view from the front and above of the actuator of FIG. 1 and a fragmentary portion of a container of a pressurized product.
Figure 3:
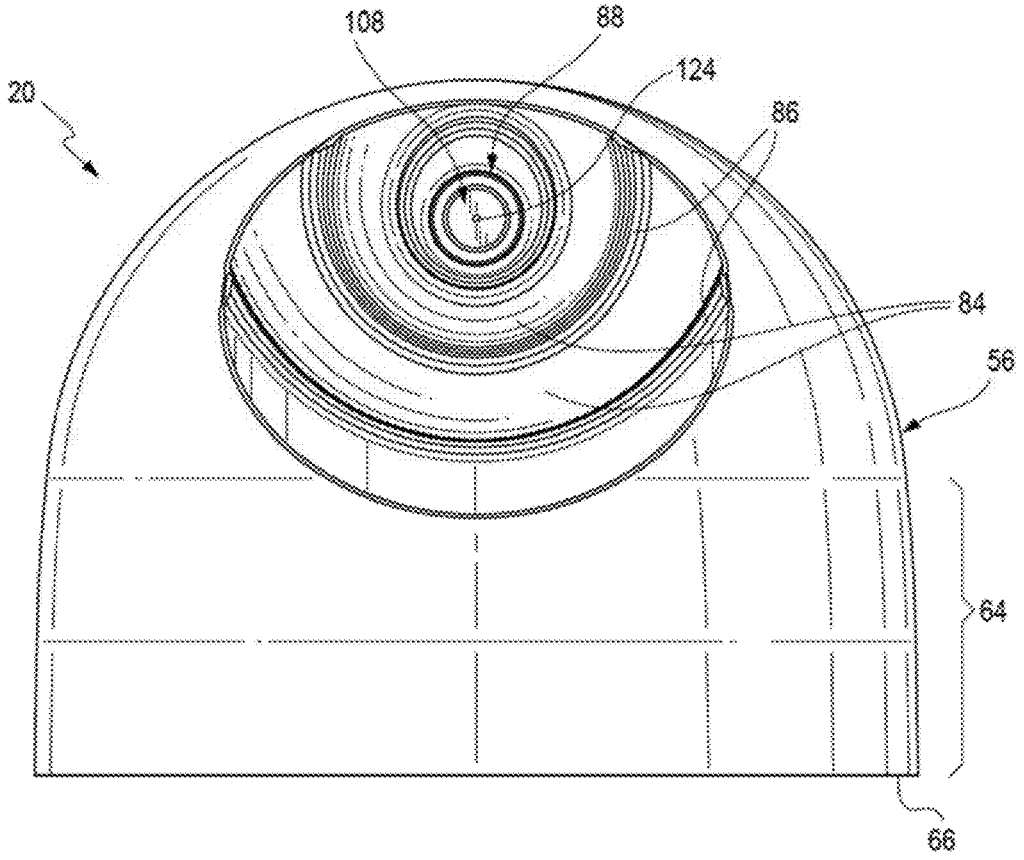
FIG. 3 is a front elevation view of the actuator of FIG. 1.
Figure 4:
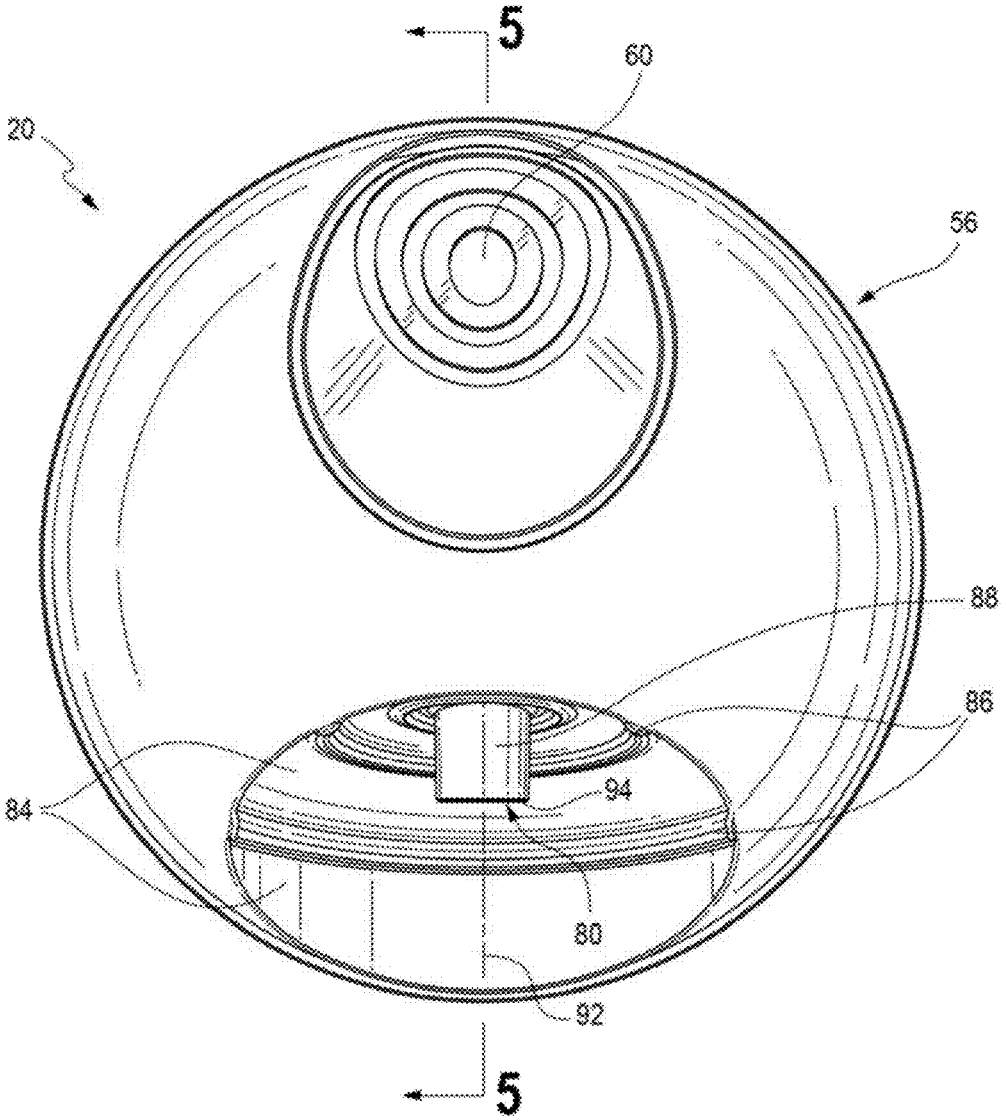
FIG. 4 is a top plan view of the actuator of FIG. 1.

With reference to FIG. 2, the dispensing valve 28 may be of any suitable conventional or special type. The dispensing valve 28 will typically include a body (not visible in FIG. 2 in the container 24), and the valve body contains the working components of the valve, with the bottom end of the body being attached to a conventional dip tube (not visible) that directs the fluent product from the container 24 and into the valve body to be dispensed from the container 24. The upper end of the valve body typically has a valve stem 40 that projects above the top of the container 24 to be actuated from a closed position (wherein fluent product is not dispensed through the valve 28) to an open position (wherein the fluent product is dispensed through the valve 28 via the valve stem 40). Typically, the valve stem 40 is biased to the closed position, such as by a spring (not visible) contained in the valve body, so that the valve 28 is normally closed unless forced to the open position by the actuator 20 as it is actuated by a user. After the dispensing valve 28 is actuated to dispense product, such as an atomized spray or a foaming liquid, the user terminates the actuation operation so that the valve stem 40 is returned by the spring to the closed position condition wherein the valve 28 is closed.

The dispensing valve 28 may be mounted to the container 24 by any suitable means, one such suitable means being a conventional valve mounting cup which has a mounting flange with an outer peripheral portion that can be crimped about the container mounting bead to provide a secure and sealed attachment of the mounting cup to the container 24 at the container opening. The mounting cup includes an annular inner wall (not visible in FIG. 2) which defines an opening through which a portion of the valve body projects, with a portion of the annular inner wall crimped to the exterior of the valve body to provide a secure and sealed attachment of the valve body to the mounting cup. U.S. Published Application Number 2008/0210710 A1, and U.S. Pat. Nos. 7,249,692 and 7,861,894 each show and describe in further detail other suitable forms of dispensing valves 28 that can be employed in connection with the present invention.

It will be appreciated that the particular type of the dispensing valve 28 may be of any suitable design for dispensing a product from the container 24 (with or without a dip tube) out through the valve stem 40. The detailed design and construction of the dispensing valve 28 per se forms no part of the present invention. It should further be understood that while the preferred embodiments of the actuator 20 are shown herein in connection with a dispensing valve 28, in some applications it may be desirable to utilize an actuator according to the invention with other types of dispensing devices, such as a hand-powered or finger-operated pump or other dispensing systems or devices.

Figure 5:
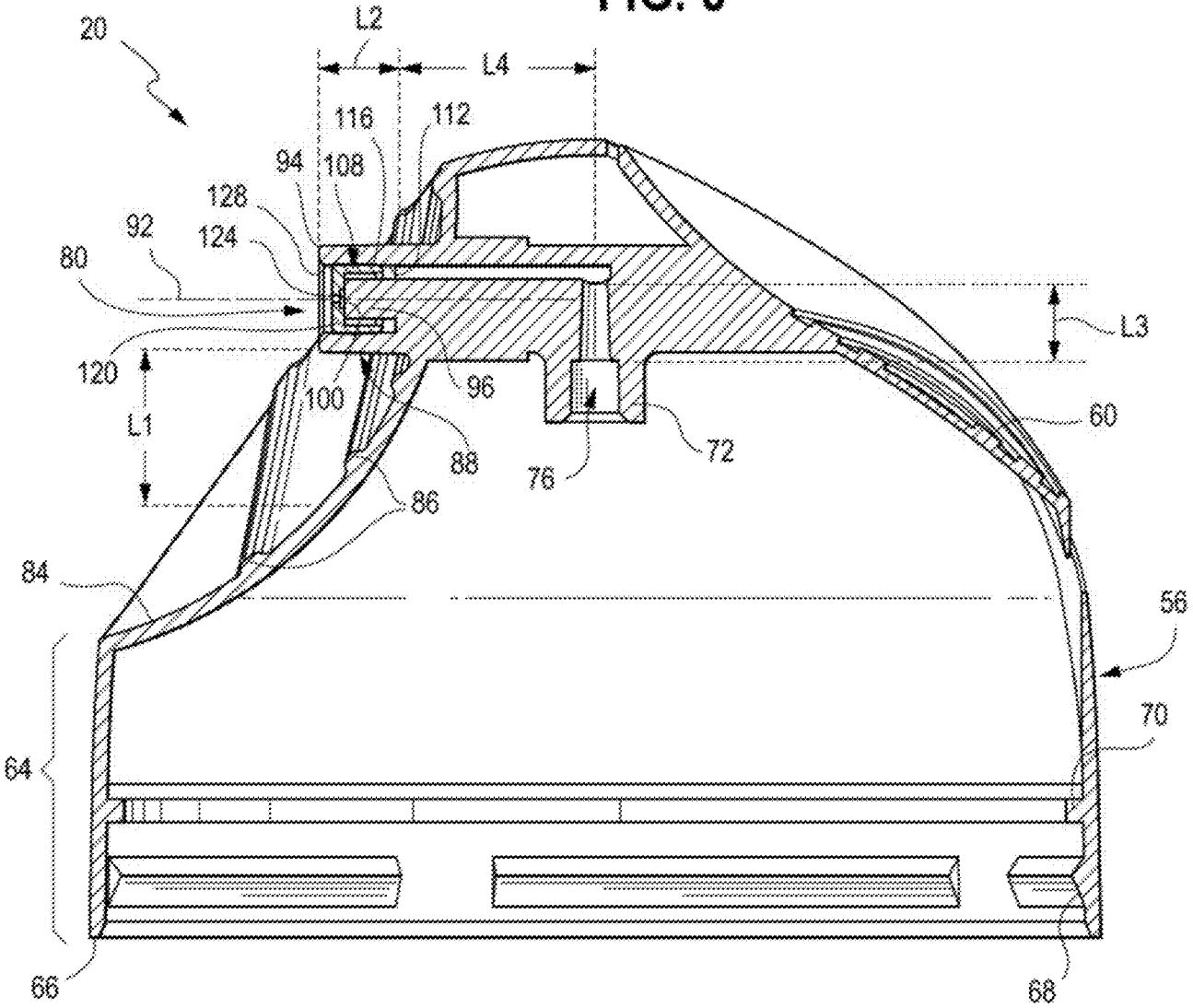
FIG. 5 is a cross-sectional view of only the actuator of FIG. 1, taken in a vertical cross-sectional plane along line 5-5 in FIG. 4.

As best seen in FIG. 5, the actuator 20 includes a base or body 56 that defines a movable or deflectable actuator button 60. The body 56 includes a downwardly extending skirt 64 defining a bottom or lower end 66 and a having a plurality of laterally inwardly extending beads 68 and an axially spaced, laterally inwardly extending abutment or flange 70 that cooperates with the beads 68 to secure the actuator 20 atop the valve 28 and the container 24 (illustrated in FIG. 2 only). Specifically, the beads 68 and the flange 70 hold captive a portion of the container and/or valve. It should be appreciated that there are many possible forms for the body 56 and the actuator button 60 depending on the intended application of the actuator 20. The body 56 includes a downwardly extending, internal stem pocket 72 to securely receive the valve stem 40 (illustrated in FIG. 2 only) at the opening of the container 24 (illustrated in FIG. 2 only). A flow passage or path 76 extends through the body 56 to direct fluent product from the valve stem 40 to the exterior of the actuator 20. In this regard, in the illustrated first embodiment of the actuator 20 of the present invention, the flow path 76 extends to an outlet, port, or exit orifice 80. The button 60 is cantilevered laterally rearwardly of the stem pocket 72 and flow path 76 defined therein. The button is deflectable or movable between (i) a neutral, non-actuating position wherein the stem pocket 72 is located so as not to actuate the valve 28, and (ii) an actuating position (e.g., FIGS. 8A and 8C) wherein the stem pocket 72 is located to move the valve stem 40 to actuate the valve 28 to dispense a fluent product. The button 60 is biased to the neutral position, which in the illustrated embodiment is the as-molded condition or as-formed condition of body 56. In some embodiments of the invention, the body 56 may be attached only to the valve, or to an aluminum can shoulder.

Figure 1:
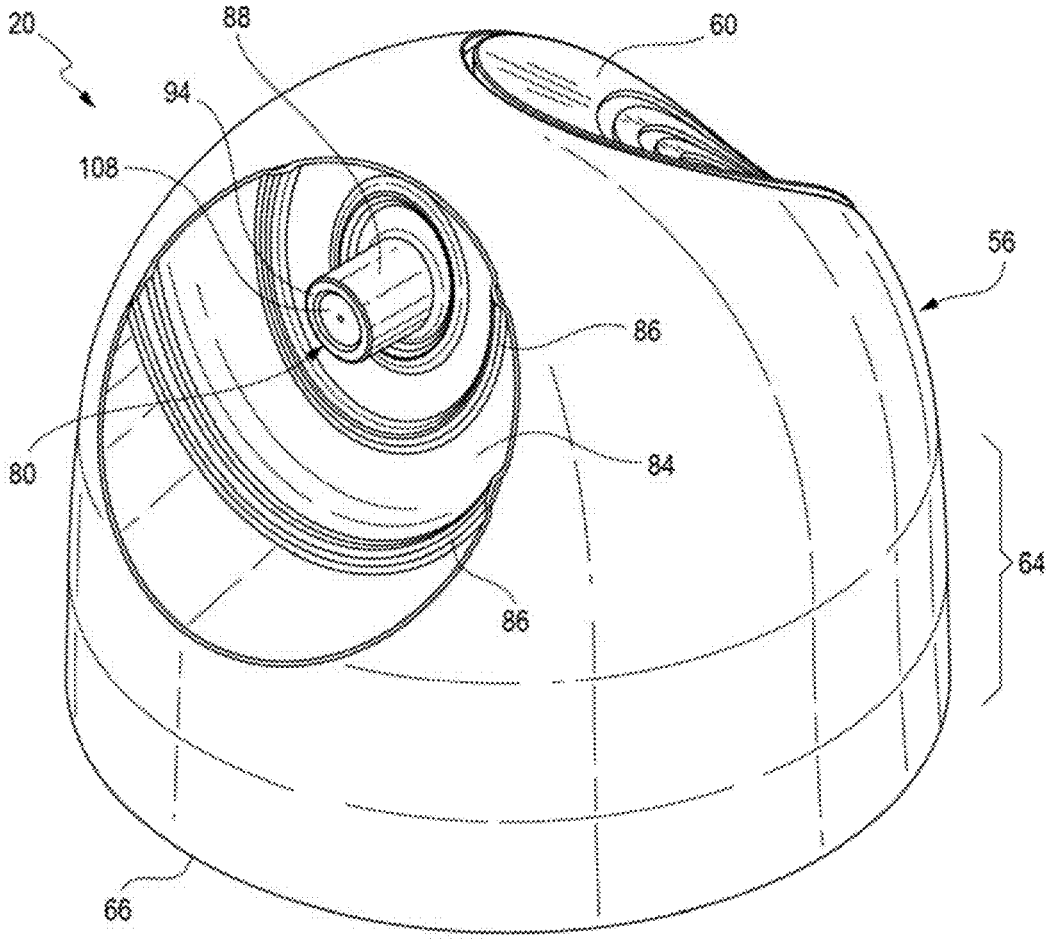
FIG. 1 is an isometric view from the front and above of a first embodiment of a hand-held, finger-operable actuator according to the invention for being installed on a container of pressurized product.

Referring now to FIGS. 1 and 5, the body 24 further includes a front exterior face 84 that is substantially dish-like and concave, when viewed from the exterior of the actuator 20. Portions of the front exterior face 84 slope downwardly below the exit orifice 80 and outwardly away from the exit orifice 80, and portions of the front exterior face 84 extend above and adjacent to the exit orifice 80 to fully surround the exit orifice 80.

The front exterior face 84 includes a plurality of spaced apart concentric ridges 86 that function to improve cleanliness of the actuator 20 by impeding the flow of any fluent substance that could potentially drop onto the front exterior face 84.

The body 56 includes a tube or hollow extension, or simply "extension" 88 defining a portion of the flow path 76 (visible in FIG. 5) and extending along, and centered on, a longitudinal axis 92 (visible in FIG. 5). The hollow extension 88 extends laterally or axially outwardly, along the longitudinal axis 92, from its connection to the remainder of the body 56, surrounded by the front exterior face 84, and the extension 88 defines a terminal portion or end 94 at or surrounding the exit orifice 80. The terminal portion 94 is located radially above a portion of the front exterior face 84, relative to the longitudinal axis 92, as will be discussed in greater detail herein.

Figure 6:
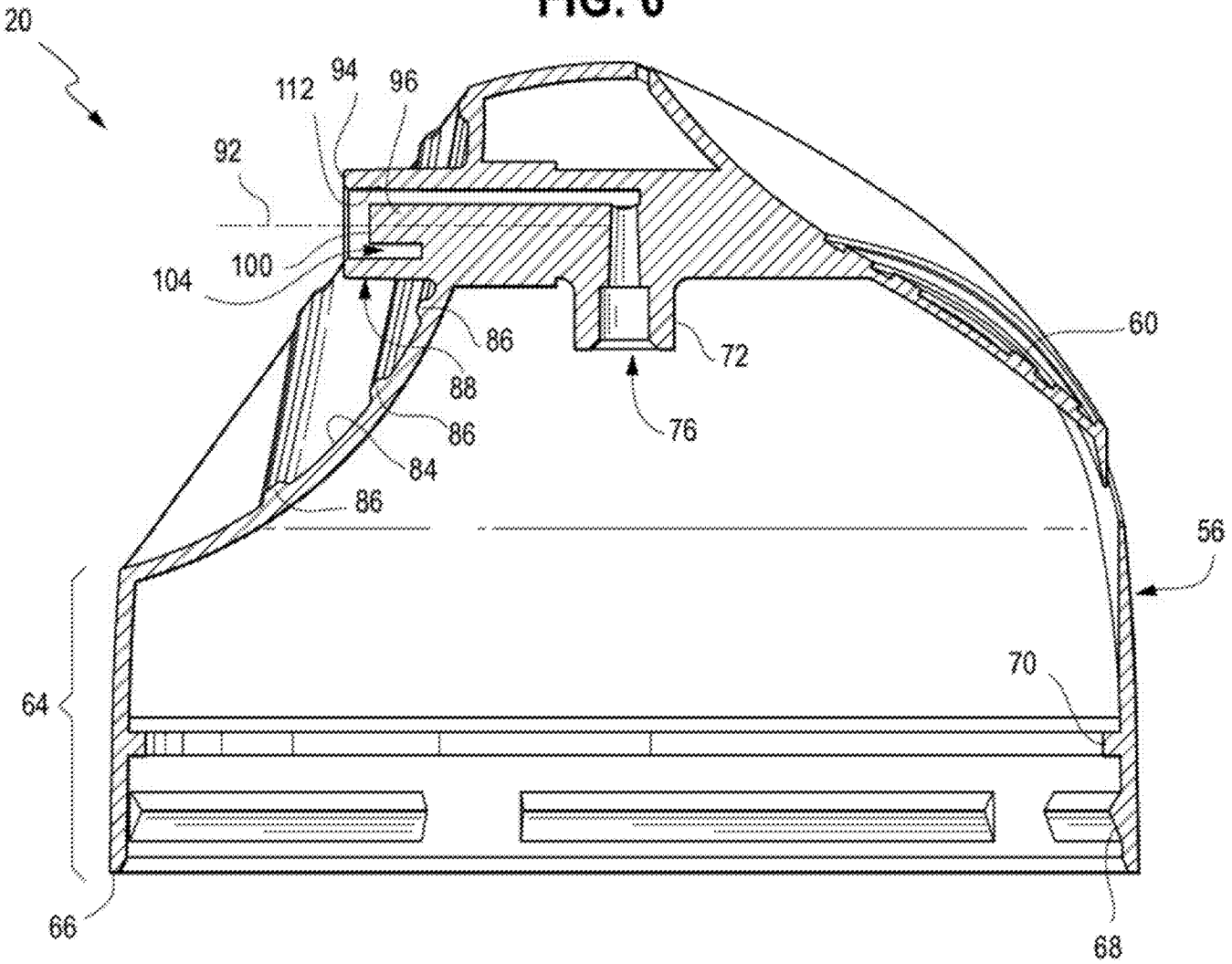
FIG. 6 is a cross-sectional view of the actuator of FIG. 1 prior to installation of an insert, and taken in a vertical cross-sectional plane along line 5-5 in FIG. 4.

With reference to FIGS. 5 and 6, the hollow extension 88 includes a cylindrical, internal post 96 extending within the extension 88 along, and centered on, the longitudinal axis 92. The post 96 defines a circular, flat end face 100 that is located axially inward of, or recessed relative to, the exit orifice 80, along the longitudinal axis 92. An annular space or recess 104 (FIG. 6) is formed within the extension 88 and surrounds the post 96, which accommodates a spray insert or mechanical breakup unit (MBU) 108 (FIG. 5) as will be discussed hereinafter.

With reference to FIGS. 2 and 5, the insert 108 is generally cylindrical and hollow to be received within extension 88, with the insert 108 having a friction or press fit with the cylindrical interior surface 112 of the hollow extension 88 to retain the insert 108 at or adjacent the exit orifice 80. The insert 108 includes an annular, cylindrical wall 116 terminating in a planar front wall or plate 120 having a single aperture 124 for being arranged in a confronting position relative to the end face 100 of the post 96 with the insert 108 assembled within the extension 88 (as illustrated in FIG. 5). Preferably, the planar front wall 120 containing the aperture 124 is offset or spaced axially inward of the exit orifice 80 of the extension 88, in the direction along axis 92, by an annular internal surface or land 128, preferably between about 0.5 and about 1.0 millimeters, and more preferably by about 0.85 millimeters. The offset of the planar front wall 120 containing the aperture 124 from the exit orifice 80 on the extension 88 may assist in the formation of the spheroid or bolus of foaming fluent material upon actuation of the actuator 20 and to further assist in the cleanliness of the actuator 20 during operation, which will be discussed in further detail below. It will be understood that one or both of the insert 108 and the end face 100 of the post 96 will have one or more flow channels therein for accommodating flow from the passage 76 to the aperture 124 and the exit orifice 80. For example, the end face 100 could be provided with a single, linear channel or groove extending transverse to the axis 92, or may alternatively be cone shaped with the point of the cone centered on the aperture 124. A variety of post and insert flow channels are disclosed in PCT Publication No. WO 2013/055323 A1, and any of these post and/or insert flow channel geometries, or other geometries of flow channels, may be provided at the post and insert interface of the actuator 20 to provide the desired spray pattern or profile.

The inventors have discovered that the unique flow structure of the actuator 20 minimizes, or at least reduces, the accumulation of a fluent product, especially a foaming liquid product, at the exit orifice 80 and substantially reduces or eliminates spreading of the product from the exit orifice 80 to the front exterior face 84 during repeated uses of the actuator 20. It is currently believed that the hollow extension 88 creates a land for the residual foam to cling to at the orifice 80 so as to provide an air gap about the orifice 80 and the exterior face 84 so that the residual fluent product cannot bridge or collect on adjacent surfaces of the face 84 near the orifice 80.

Figure 8A:
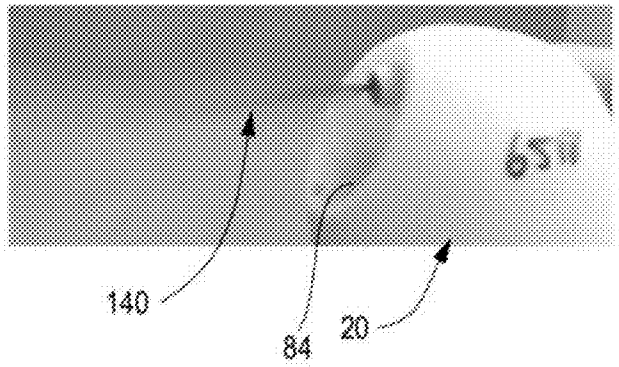
Figure 8B:
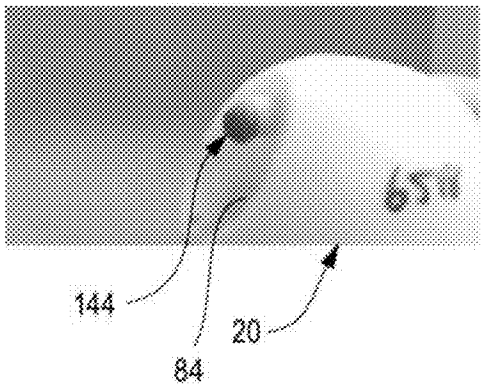
Figure 8C:
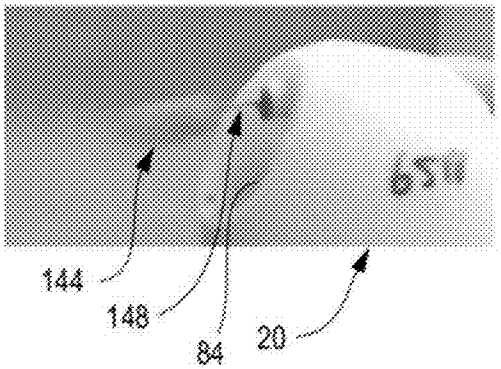

As can be seen in FIG. 8A, in the actuator 20 made according to the present invention, an initial actuation causes a first jet of the fluent product 140 to exit from the orifice. With reference to FIG. 8B, after a given actuation the residual fluent product or foam collects in a spheroid 144 at the orifice of the actuator 20. The collection of fluent product is advantageously located above and laterally away from the sloping lower portion of the front exterior face 84. As can be seen in FIG. 8C, the spheroid 144 is subsequently jettisoned away from the orifice by a second jet of fluent substance 148 with a subsequent actuation of the actuator 20. When the product is a foam, the foam does not appreciably accumulate on the actuator 20 since it is blown away with each subsequent spray, especially if the sequential sprays are done in close succession prior to the foam collapsing into liquid. Prior art actuators have exhibited an accumulation of product at the exit orifice of actuators, which could undesirably drip onto the remaining portion of such actuators and on the containers upon which they are installed. The accumulated product could also drip onto furniture, countertops, storage areas, etc. In the actuators of the present invention, it is believed that the maximum amount of residual foam that collapses over time into liquid on the actuator is limited to the residue resulting from one actuation because there is little to no cumulative or snowball effect owing to each successive spray 'cleaning' the residual foam of the preceding spray off of the actuator.

The actuator 20 according to a preferred form of the present invention is further advantageous in that the exit orifice 80 is located at a recessed location that is axially or laterally inward of the circumference of the skirt 64 for reduced use of plastic and which avoids the cost and complexity associated with additional elongate tubes of the prior art that extend laterally far beyond the actuator (e.g., several multiples of the width of the actuator). Furthermore, it has been found by the inventors that the prior art elongate tubes may be prone toward accumulation of sprayed foam and subsequent unwanted dripping. The inventors believe that the provision of such prior art elongate tubes actually exacerbates the accumulation of foam at the exit orifice by providing additional internal flow path volume in which a foam may expand prior to reaching the exit orifice.

Figure 7:
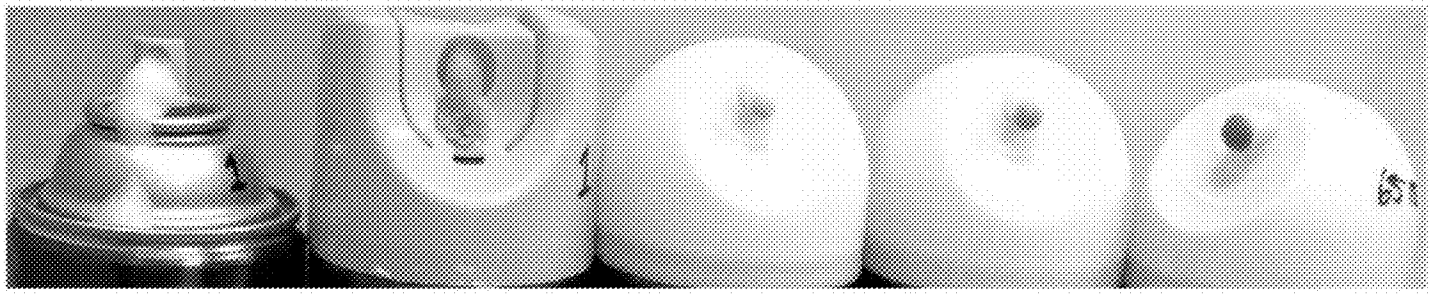

With reference to FIG. 7, which shows two different prior art actuators on the left that lack any extension portion of the actuator at the exit orifice, it can be seen that such prior art actuators develop a substantial, undesirable accumulation of fluent material and subsequent snowballing of fluent material down the actuator body and container upon repeated uses of such actuators, which is particularly pronounced with a foaming liquid product. FIG. 7 further shows three different embodiments of the actuator according to the present invention, which do not exhibit such accumulation of fluent material after the same number of uses.

This demonstrates one broad aspect of the invention, namely that the actuator 20 includes a means for retaining an accumulation of the fluent product at the exit orifice 80, but at a location that is spaced away from the front exterior face 84.

With reference to FIG. 5, the presently preferred means is an extension 88 that extends axially beyond its connection to the front exterior surface 84 of the body 56, and that terminates radially above a portion of the front exterior face 84 of the actuator body 56, relative to the axis 92. Preferably, the bottom of the terminal portion 94 of the extension 88 is located a distance L1 radially above the portion of the front exterior face 84 that is directly below the terminal portion 94 of at least about 6 millimeters, relative to the axis 92. The extension 88 preferably extends along the axis 92 a distance L2 of at least 3 millimeters away from the connection with the front exterior face 84, as measured from the underside of the extension 88. In one preferred form, the extension 88 has an outer or external diameter between about 5 and about 9 millimeters, and more preferably an outer diameter of about 6.5 millimeters. Preferably, the extension 88 is unitarily formed with the rest of the actuator body 56 so as to minimize the cost of assembly, weight and material volume used in manufacturing the body 56. Preferably, the wall thickness of the hollow extension 88 at the exit orifice 80 is about 1.25 millimeters. More preferably, the extension 88 is employed on an actuator having a generally dish-like, concave front exterior face 84.

Still referring to FIG. 5, in one presently preferred form of the actuator 20, the internal volume of the portion of the flow passage 76 between the valve stem 40 and the insert 108 (extending along lengths L3 and L4) is about 30 cubic millimeters, which is about half the 50 to 60 cubic millimeter volume of the flow passage of a conventional long spray actuator. The inventors believe that the minimization or at least reduction in the internal volume of the flow passage 76 can further assist in the advantageous cleanliness (mitigation of foaming) at the exit orifice 80 of the actuators according to the present invention. The inventors have found that the actuator 20 will leave a reduced mess on the actuator, container, and hands of the user compared to prior art actuators. Further, the potential for dripping onto delicate surfaces such as furniture or stone countertops, storage areas, may be reduced. The inventors believe that the actuators 20 disclosed herein are more cost effective than other complicated systems, such as collapsing flow paths or sealing features, which are intended to minimize foam residue on a spray actuator.

In other, non-preferred forms of the invention, the exterior face 84 could be a sloping flat surface (not illustrated) or a downwardly sloping convex surface (not illustrated).

While foaming products vary in the rate and amount of accumulated foam, cling characteristics, and collapse rates, which may depend on the formulation of the fluent material and the propellant, the inventors believe that the present invention may be implemented and optimized for a range of fluent foaming products.

It should be understood that while some preferred embodiments are shown, these embodiments are illustrative of the concepts of the invention and that there are many possible forms for the actuator, post, flow channels, spray insert, and exit orifice that are within the scope of the invention. For example, the size of flow channel and the exit orifice can be modified from those illustrated to achieve different fan spray patterns and/or to accommodate different fluent products and/or different dispensing pressures. As a further example, while many of the features have annular or cylindrical geometries, other geometries may be desirable depending upon the particular requirements of each application.

As yet a further example, while much of the flow path extends transverse to a long axis of the container, any other orientation is possible within the scope of the invention and other orientations may be more desirable depending upon the requirements of each application. As an even further example, while the flow channels and orifices in the illustrated embodiments are shown centered on the longitudinal axis of the post, it may be desirable in some applications for the flow channel and/or orifice to be offset relative to the longitudinal axis.

Additionally, while the flow path 76 of the first illustrated embodiment of the actuator 20 is shown extending from the stem pocket 72 to the exit orifice 80 vertically along a path length L3, and then joining at a right angle a horizontal path length L4, in some applications it may be desirable for the axis 92 to extend at other angles, such as, for example vertically, or as a further example, at a 45 degree angle relative to horizontal. Furthermore, while all of the illustrated embodiments show a single flow path 76 and exit orifice 80 combination, it may be desirable to provide multiple such flow paths in a single actuator.

Figure 9:
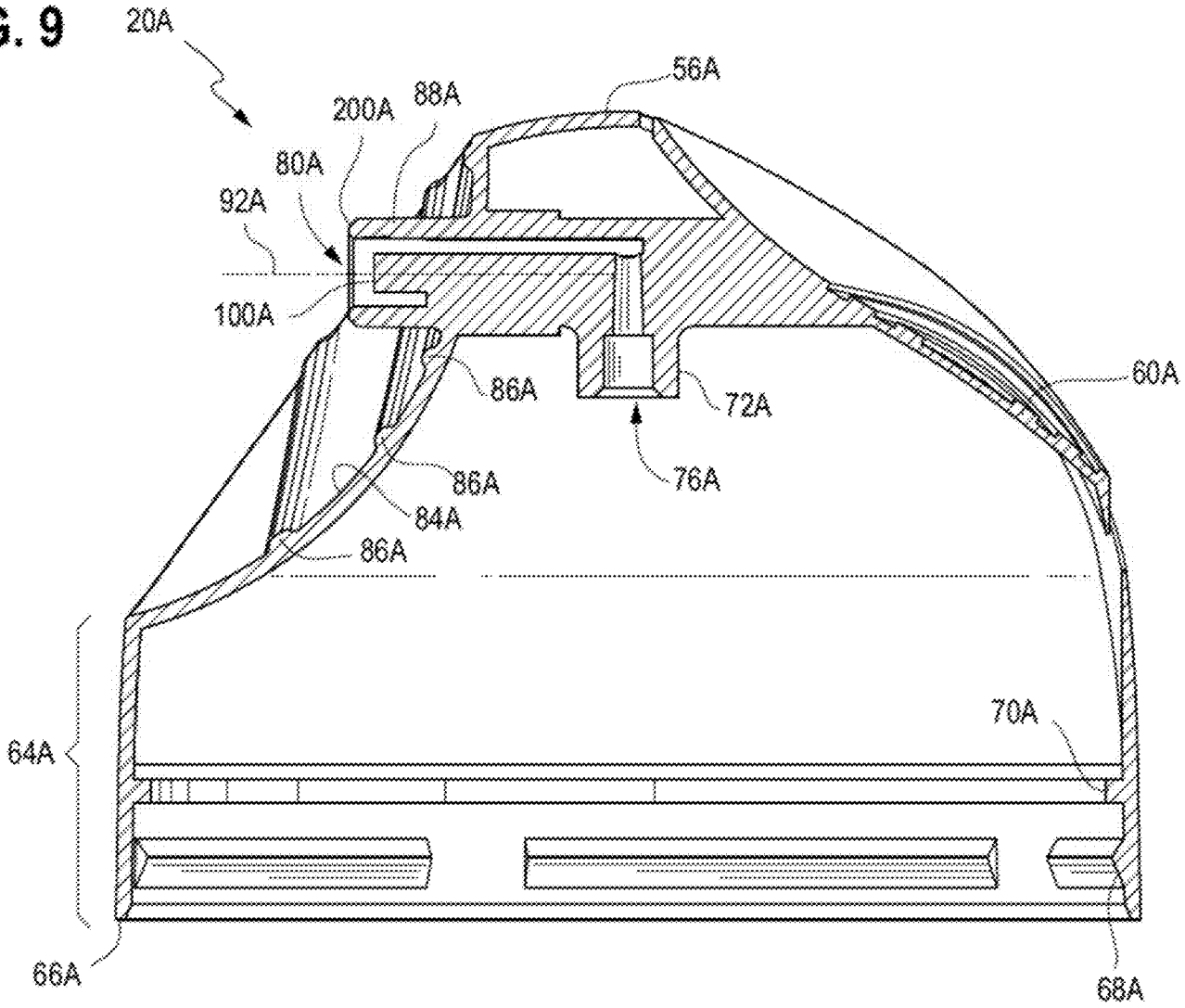
FIG. 9 is a cross-sectional view of another embodiment of an actuator according to the present invention, taken along a vertical cross-sectional plane extending through the center of the hollow extension (similar to FIG. 6)

A second embodiment of an actuator 20A according to the present invention is illustrated in FIG. 9. Like elements between the first illustrated embodiment of the actuator 20 and the second illustrated embodiment of the actuator 20A are designated with the same numeral (the first embodiment having no suffix and the second embodiment having a "A" suffix). The second illustrated embodiment of the actuator 20A has the same basic elements as the first illustrated embodiment of the actuator 20. The actuator 20A includes a body 56A that defines a movable or deflectable actuator button 60A. The body 56A includes a downwardly extending skirt 64A terminating in a bottom end 66A and to secure the actuator 20A atop a valve and/or a container having a valve therein (illustrated in FIG. 2 only). The body 56A includes a stem pocket 72A to receive the valve stem (illustrated in FIG. 2 only) at the opening of the container. A flow passage or path 76A extends through the body 56A to direct fluent product from the valve stem to the exterior of the actuator 20A via an exit orifice 80A. The body 56A further includes a front exterior face 84A that is substantially dish-like and concave, when viewed from the exterior of the actuator 20A, and which slopes downwardly below, extends above, and extends adjacent a hollow extension 88A defining a portion of the flow path 76A. The hollow extension 88A extends outwardly of the front exterior face 84A along the longitudinal axis 92A, and the extension 88A terminates at the exit orifice 80A that is located radially above the front exterior face 84A, taken along the longitudinal axis 92A.

Still referring to FIG. 9, the second illustrated embodiment of the actuator differs from the first illustrated embodiment in that the terminal portion of the extension 88A is provided with an external, annular, chamfered surface 200A to further reduce the likelihood of accumulation of a fluent substance at the exit orifice 80A. The chamfered surface 200A tapers along the longitudinal axis 92A, in an axially outwardly direction moving from the connection of the hollow extension 88A to the exterior face 84A toward the exit orifice 80A. In other forms of the present invention, not illustrated, the terminal portion of the extension 88A may be provided with an external, annular radius in place of the chamfered surface 200A.

Various modifications and alterations to this invention will become apparent to those skilled in the art without departing from the scope and spirit of this invention. Illustrative embodiments and examples are provided as examples only and are not intended to limit the scope of the present invention.

What is claimed is:

1. An actuator for actuating a valve on a container of a fluent product, the actuator comprising:

a body having a downwardly extending skirt defining a lower end for surrounding at least a portion of the container, said body including a dispensing flow path to direct a fluent product from the container to an exterior of said actuator via an exit orifice located at an end of said flow path, said body further including a front exterior face located adjacent to said exit orifice, said body including a hollow extension defining at least a portion of said flow path and extending along a longitudinal axis, wherein a terminal portion of said hollow extension extends outwardly from a portion of said front exterior face, along said longitudinal axis, and wherein said terminal portion of said hollow extension is located axially inwardly of said lower end, along said longitudinal axis, said hollow extension configured to retain an accumulation of the fluent product at said exit orifice at a location spaced radially away from said front exterior face, relative to said longitudinal axis;

wherein said hollow extension further includes a post extending therein along said longitudinal axis, said post defining an end face located axially inwardly of said exit orifice along said longitudinal axis.

2. The actuator according to claim 1 further comprising an insert for being retained within said hollow extension, said insert having at least one aperture for overlying said end face of said post with said insert in an assembled configuration retained within said hollow extension.

3. The actuator according to claim 2 wherein said insert includes a plate defining said at least one aperture that is spaced between about 0.5 and about 1.0 millimeters from said exit orifice of said hollow extension with said insert in an assembled configuration retained within said hollow extension.

4. An actuator for actuating a valve on a container of a fluent product, the actuator comprising:

a body having a downwardly extending skirt defining a lower end for surrounding at least a portion of the container, said body including a dispensing flow path to direct a fluent product from the container to an exterior of said actuator via an exit orifice located at an end of said flow path, said body further including a front exterior face located adjacent to said exit orifice, said body including a hollow extension defining at least a portion of said flow path and extending along a longitudinal axis, wherein a terminal portion of said hollow extension extends outwardly from a portion of said front exterior face, along said longitudinal axis, wherein said terminal portion of said hollow extension is located axially inwardly of said lower end, along said longitudinal axis, said hollow extension is configured to retain an accumulation of the fluent product at said exit orifice at a location spaced radially away from said front exterior face, relative to said longitudinal axis, said body further includes a deflectable actuator button that is cantilevered rearwardly relative to said front exterior face, wherein said front exterior face is generally concave when viewed from the exterior of said actuator and fully surrounds said hollow extension, and wherein said hollow extension further includes a post extending therein along said longitudinal axis, said post defining an end face located axially inwardly of said exit orifice along said longitudinal axis; and an insert retained within said hollow extension, said insert having at least one aperture for overlying said end face of said post with said insert in an assembled configuration retained within said hollow extension.

* * * * *